US008453597B2

(12) United States Patent
Ansorge et al.

(10) Patent No.: US 8,453,597 B2
(45) Date of Patent: Jun. 4, 2013

(54) PAINT SHOP AND CORRESPONDING METHOD OF OPERATION

(75) Inventors: Helmut Ansorge, Fouchtwangen (DE); Olaf Eckardt, Crailsheim (DE); Stefan Esslinger, Steinheim-Hopfigheim (DE); Jurgen Benkiser, Murr (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 888 days.

(21) Appl. No.: 12/373,816

(22) PCT Filed: Jul. 4, 2007

(86) PCT No.: PCT/EP2007/005920

§ 371 (c)(1),
(2), (4) Date: Oct. 29, 2009

(87) PCT Pub. No.: WO2008/006495

PCT Pub. Date: Jan. 17, 2008

(65) Prior Publication Data

US 2010/0047465 A1 Feb. 25, 2010

(30) Foreign Application Priority Data

Jul. 14, 2006 (DE) ..... 10 2006 032 804

(51) Int. Cl.
*B05B 15/12* (2006.01)
*B05C 3/00* (2006.01)

(52) U.S. Cl.
USPC ..... 118/326; 118/323; 118/309; 454/50; 901/43

(58) Field of Classification Search
USPC ..... 118/323, 321, 326, 309, 634, 50, 118/DIG. 7; 454/50, 53, 55; 901/49; 427/427.2; 55/DIG. 46
See application file for complete search history.

(56) References Cited

U.S. PATENT DOCUMENTS 4,630,567 A * 12/1986 Bambousek et al. ..... 118/323
5,296,029 A * 3/1994 Neikter ..... 118/326

(Continued)

FOREIGN PATENT DOCUMENTS

CN 1675002 A 9/2005
DE 806889 7/1970

(Continued)

OTHER PUBLICATIONS

International Search Report for PCT/EP2007/005920 dated Sep. 18, 2007.

(Continued)

*Primary Examiner* — Yewebdar Tadesse
(74) *Attorney, Agent, or Firm* — Bejin, VanOphem & Bieneman PLC

(57) ABSTRACT

The invention relates to a paint shop, especially for elongate components, such as e.g. motor vehicle bumpers, motor vehicle sillboards or for components of aircraft and wind-power installations. Said paint shop comprises a transport path (4) for transporting components (2) to be painted through the paint shop, a painting robot (13, 16) for painting the components (2) and a travel path (12, 15) for positioning the painting robot (13, 16) along the travel path (12, 15). The invention is characterized in that the travel path (12, 15) of the painting robot (13, 16) extends at a right angle to the transport path (4) for the components (2) to be painted. The invention also relates to a corresponding method of operation.

19 Claims, 6 Drawing Sheets

U.S. PATENT DOCUMENTS

| | | | | |
|---|---|---|---|---|
| 5,336,321 | A * | 8/1994 | Sugata et al. | 118/315 |
| 6,641,667 | B2 * | 11/2003 | Ochiai et al. | 118/323 |
| 2003/0136338 | A1 * | 7/2003 | Pohl et al. | 118/326 |
| 2004/0028823 | A1 | 2/2004 | Dutt | |
| 2005/0051085 | A1 * | 3/2005 | Krogedal et al. | 118/313 |
| 2006/0207500 | A1 | 9/2006 | Herre | |
| 2008/0047486 | A1 * | 2/2008 | Herre et al. | 118/75 |

FOREIGN PATENT DOCUMENTS

| | | | |
|---|---|---|---|
| DE | 4114762 | | 11/1992 |
| DE | 69012706 | T2 | 1/1995 |
| DE | 102005013014 | | 10/2006 |
| EP | 0411846 | | 2/1991 |
| GB | 787018 | A | 11/1957 |
| GB | 2190312 | | 11/1987 |
| GB | 2246963 | | 2/1992 |
| GB | 2263422 | | 7/1993 |
| JP | 3095943 | A | 4/1991 |
| WO | WO-2004/014572 | A1 | 2/2004 |
| WO | 2004037436 | | 5/2004 |
| WO | 2005035141 | | 4/2005 |

OTHER PUBLICATIONS

Article: Einsatzmoglichkeiten aurch neue Generation Durchlauf-Spritzlackieranlagen enorm ertweitert, Book: I Lack, Aug. 1991 59 Jahrgang, 3 pages, Publisher: Beitrage Gesprache Berichte, Germany.

Pavel Svejda, Article: Prozesse und Applikationsverfahren in der industriellen Lackiertechnik, Magazine: Moderne Lackiertechnik, 4 pages, Publisher Herausgegeben von U Zorll und D. Ondratschek, Germany.

* cited by examiner

PAINT SHOP AND CORRESPONDING METHOD OF OPERATION

CROSS REFERENCE TO RELATED APPLICATIONS

This application is a National Stage of PCT/EP2007/005920, with a filing date of Jul. 4, 2007, which claims priority to DE 102006032804.3, filed Jul. 14, 2006, which are hereby incorporated by reference in their entirety.

The invention relates to a paint shop for painting components, particularly for painting plastic components and preferably elongate components, e.g. motor vehicle bumpers or sills, and a corresponding method of operation in accordance with the sub-claims.

In the conventional painting of motor vehicle bumpers ("fenders"), they are usually hung from skids, with which they are moved along a linear transport path through the paint shop into a paint cabin, in which the motor vehicle bumpers are painted by a multiple-axis painting robot located at the side of the transport path, where the motor vehicle bumpers are aligned in parallel with the transport path so that the painting movement is also executed parallel to the transport path, to facilitate painting of the motor vehicle bumpers throughout their entire length ("from ear to ear").

An initial disadvantage of the known paint shops described above for painting motor vehicle bumpers is the fact that the motor vehicle bumpers to be painted in the paint cabin have to be aligned parallel to the transport path, painting taking place in the direction of the entrance and exit.

In the conventional painting movement in the direction of transport of the motor vehicle bumpers, overspray can enter adjacent painting and other zones due to its kinetic energy, where it can cause undesirable contamination.

Firstly, this is prevented in conventional paint shops by the adjacent areas in the direction of transport, e.g. painting robots, dryers or mounting stations, being arranged at a certain distance apart.

Secondly, such contamination between adjacent paint cabins is prevented by setting a sufficient air sinking velocity in the individual paint cabins.

In addition, the contamination hazard means that the paint cabins must be a certain distance apart in the direction of transport, to prevent contamination. This then requires greater volumes or air to operate the cabins, which is associated with increased energy consumption.

A further disadvantage of known paint shops for painting motor vehicle bumpers is the fact that motor vehicle bumpers frequently cannot be painted throughout their entire length ("from ear to ear").

Moreover, the paint cabins in the known paint shops for painting motor vehicle bumpers described above are also entered by maintenance staff, so the paint cabin is not a genuine clean room. This problem is intensified by the requirement for maintaining the application technology used (e.g. rotary atomizers) inside the paint cabin.

A further disadvantage of the known paint shops for painting motor vehicle bumpers described above is that the motor vehicle bumpers must be turned after painting and aligned at right angles to the transport path, to reduce the overall length of the subsequent dryer. However, rotation of the motor vehicle bumpers between painting and subsequent drying requires complicated turning stations and slows down the painting process, as turning the motor vehicle bumpers takes up a certain time.

The invention is therefore based upon the problem of improving the conventional paint cabins described above and corresponding methods of operation.

This problem is solved by an inventive paint shop and a corresponding method of operation in accordance with the sub-claims.

The invention includes the general technical teaching of aligning the components to be painted, e.g. motor vehicle bumpers, in the paint cabin, so that the painting movement is executed transverse to the transport path instead of parallel to it, as in the prior art described above. Such alignment of the components to be painted has the advantage that the requisite overall length of the paint cabins can be reduced, as elongate components with the inventive transverse alignment, e.g. motor vehicle bumpers, require less space in the direction of transport.

Moreover, the invention preferably provides for the painting robot in the paint cabin to be moveable along a travel path which is designated as the axis of travel, where the axis of travel is preferably transverse to the transport path of the components to be painted. When painting elongate components, e.g. motor vehicle bumpers, such painting robot mobility transverse to the transport path and parallel to the elongate components advantageously facilitates component painting throughout their entire length ("from ear to ear"). The travel path of the painting robot is preferably linear, preferably aligned transverse to the path. However, the invention is not restricted to linear travel paths for the painting robot, but also includes arrangements in which the travel path is curved, has branches and/or forms a closed circuit. The concept of a linear path used within the scope of the invention therefore does not mean that the path is straight. On the contrary, the linear transport path in the invention may also be curved.

It must also be mentioned that the travel path of the painting robot is preferably located above the transport path of the components to be painted, in order not to block the transport path, so that the components to be painted on the transport path are conveyed below the travel path of the painting robot. The location of the painting robot above the components to be painted also provides the advantage of enhancing the efficiency of application and reducing the volume of overspray, as most painting takes place in a downward direction. Moreover, this permits achievement of a lower air sinking (downward) velocity inside the cabin. A further advantage of this arrangement of the painting robot travel path is that the supporting structure of the paint cabin floor can be made much simpler and thus smaller, as there is no need to absorb dynamic forces from the robots. This arrangement also has considerable advantages in respect of overspray deposits and the associated cleaning costs. In this connection, the direction of spraying also has the advantage that painting is not taking place in the direction of the cabin entrances and exits.

It must also be mentioned that the travel path of the painting robot in the paint cabin is preferably located at the entrance and/or exit end, i.e. at the short sides of the paint cabin. Such short-side location of the painting robots advantageously facilitates a continuous clean room design in the paint shop or hall. This means that the paint cabin has no apertures through which dirt can enter. Instead, the paint cabin can, for example, be fitted with continuous glazing, to implement the clean room concept. For this reason, the supply cabinets for the painting robot are preferably located on the short sides of the paint cabin, i.e. at the entrance or exit end.

Within the scope of the invention, the possibility also exists of accommodating several successive painting zones in one paint cabin, to increase painting capacity. In the inventive paint shop, this means that painting robot travel paths are not only located at the entrance and/or exit, but also between them. For example, a travel path may be located in the centre of the paint cabin, in addition to and between a travel path on the entrance side and a travel path on the exit side.

The inventive paint shop also preferably has a drip tray located under the painting robot, preventing coating agents, dirt or dried overspray falling or dripping from the painting robot on to the components being conveyed below it. This drip tray may, for example, be a trough which preferably extends throughout the entire length of the painting robot travel path, to prevent superfluous coating agent (overspray) from dripping down in any position of the painting robot on the travel path. The drip tray can also trap grit caused by the painting robot as it moves along its travel path and which could fall on to the components to be painted.

However, instead of a drip tray, a tunnel may also be provided to protect the components to be painted from contamination from above, whereby the transport path of the components to be painted extends at least through the tunnel underneath the painting robot.

The invention also preferably provides for the paint cabin having a closeable maintenance aperture, facilitating servicing of the painting robot when open. This maintenance aperture is preferably located at the side of the painting cabin and the painting robot travel path preferably has a maintenance position in which the painting robot is adjacent to the maintenance aperture. For maintenance purposes, the painting robot is therefore moved along the travel path into the maintenance position in which it is adjacent to the maintenance aperture, facilitating simple servicing of the painting robot.

The painting robot preferably carries an application device (e.g. a rotary atomiser), which may be held though the opened maintenance aperture outside the paint cabin, so that the application device may be serviced outside the paint cabin.

Moreover, the painting robot may also carry additional application systems (e.g. colour changers) on a robot arm, whereby the application systems mounted on the robot arm can be serviced outside the paint cabin, by the painting robot extending the robot arm with the application system mounted on it through the maintenance aperture out of the paint cabin.

The maintenance aperture is thus opened during servicing, whereupon the painting robot in the maintenance position on the travel path extends the application device and/or the application system through the maintenance aperture, so that maintenance staff outside the paint cabin can service the application device and/or application system without having to enter the paint cabin. In this advanced embodiment, the invention thus offers the advantage of the maintenance area and the clean room inside the paint cabin being completely separated from each other, as maintenance work need not be carried out inside the paint cabin or paint shop.

In extreme circumstances, even the entire painting robot can be serviced, without the maintenance staff having to enter the paint cabin for this purpose. The painting robot may be moved out of the paint cabin for this purpose, e.g. through the maintenance aperture or otherwise, so that servicing from outside is possible. The travel path thus has a painting position inside the paint cabin and a maintenance position outside the paint cabin. During painting, the painting robot is in the painting position, whilst it is moved into the maintenance position outside the paint cabin for servicing.

This creates the possibility of locating a maintenance area in which the painting robot can be serviced outside the paint cabin itself. The painting robot travel path then extends out of the paint cabin into the maintenance area, so that the painting robot may be moved along the travel path out of the painting cabin into the maintenance area, where the painting robot is serviced. The maintenance area is then preferably closed, preventing the emission of solvents, which is particularly advantageous in recirculatory paint cabins.

In a preferred specimen embodiment of the invention, the paint cabin has two levels, one above the other, the transport path and the components to be painted being located on the lower level, whilst the painting robot travel path and/or a supply cabinet for the painting robot is/are located on the upper level.

The lower level of the paint cabin is then preferably an operating level, on which the operators can operate the paint shop. The upper level of the paint cabin is preferably a maintenance level, on which the maintenance staff can service the paint shop.

The lower level of the paint cabin may, for example, have a height of 1-2 m, whereby a height of 1.45 m has proved advantageous in a preferred specimen embodiment. The upper level of the paint cabin may, for example, have a height of 0.8-2 m, whereby a height of 1.2 m has proved advantageous in a preferred specimen embodiment. The width of the paint cabin may, for example, be in the range of 3-7 m, whereby a cabin width of 4.5-5 m has proved advantageous in a preferred specimen embodiment. Finally, the height of the paint cabin may be in the range of 2-6 m, whereby a height of 4 m has proved advantageous in a preferred specimen embodiment.

Erection of the supply cabinets for the painting robot on a platform on the upper level at the same height as the painting robot advantageously facilitates the implementation of a continuous clean room concept.

The paint cabin also preferably has transparent walls or windows, through which the interior of the paint cabin may be observed from the outside. For this purpose, the inventive paint cabin preferably has a catwalk affixed to the side of the paint cabin. The catwalk preferably extends around the entire perimeter of the paint cabin, so the maintenance and operating staff can observe and monitor the painting processes proceeding inside the paint cabin from all sides. However, it is possible, as an alternative, for the catwalk to be affixed only to the long sides or short sides of the paint cabin.

In an alternative embodiment of the invention, the components to be painted are conveyed continuously (i.e. jerk-free at a specific conveying speed), which is itself known. The conveying speed can be adjusted as a function of process parameters (e.g. type of paint, type of component, etc) with such continuous conveying.

In an alternative embodiment, the components to be painted are conveyed in a stop-and-go mode, which is also already known. In such a stop-and-go mode, the cycle times, the duration of the conveying phases and/or the duration of stop phases can be set as a function of process parameters (e.g. type of paint, type of components, etc).

Within the scope of the invention, the possibility also exists for additional painting robots or painting machines to be located alongside the transport path. These additional painting robots or painting machines may be optionally stationary or moveable in parallel to the transport path. The advantage of such an arrangement is the fact that painting robots which can be moved transverse to the transport path do not interfere with the painting robots or painting machines located alongside the transport path, precluding collisions.

The concept of an application device used within the scope of the invention should be understood in general terms and not restricted to the aforementioned rotary atomiser. On the contrary, within the scope of the invention, this concept also includes other types of application devices such as, in general, atomisers, air atomisers, airless devices, air-mix devices and disc atomisers.

Moreover, the invention is not restricted to certain types of coating agents in respect of the coating agent to be used. For example, powder coatings, aqueous paints, solvent- or water-based paints may be applied within the scope of the invention. Furthermore, the invention may also be used to apply fillers, base coats or clear coats.

The concept of a painting robot used within the scope of the invention must also be interpreted in general terms and is not restricted to the preferably used multiple-axis painting robots, which are themselves known from prior art.

In addition, the inventive coating system is not only particularly well suited to painting motor vehicle bumpers, as described above. On the contrary, the invention also covers the use of this coating system in general for painting elongate components, such as motor vehicle sills. The inventive coating system can also be used to paint aircraft components, such as, for example, tailplanes, wings, fuselages or parts thereof. The inventive coating system is also well suited for painting components of wind turbines, such as, for example, rotor blades, pylons or gondolas. The inventive paint shop can also be used simply to paint vehicle bodies or parts thereof. Finally, the concept of a component to be painted used within the scope of the invention also includes plastic components in general, such as, for example, mudguards and spoilers.

Other advantageous embodiments of the invention are characterised in the sub-claims or explained below in conjunction with the description of preferred embodiments of the invention, using the drawings.

Figure 1:
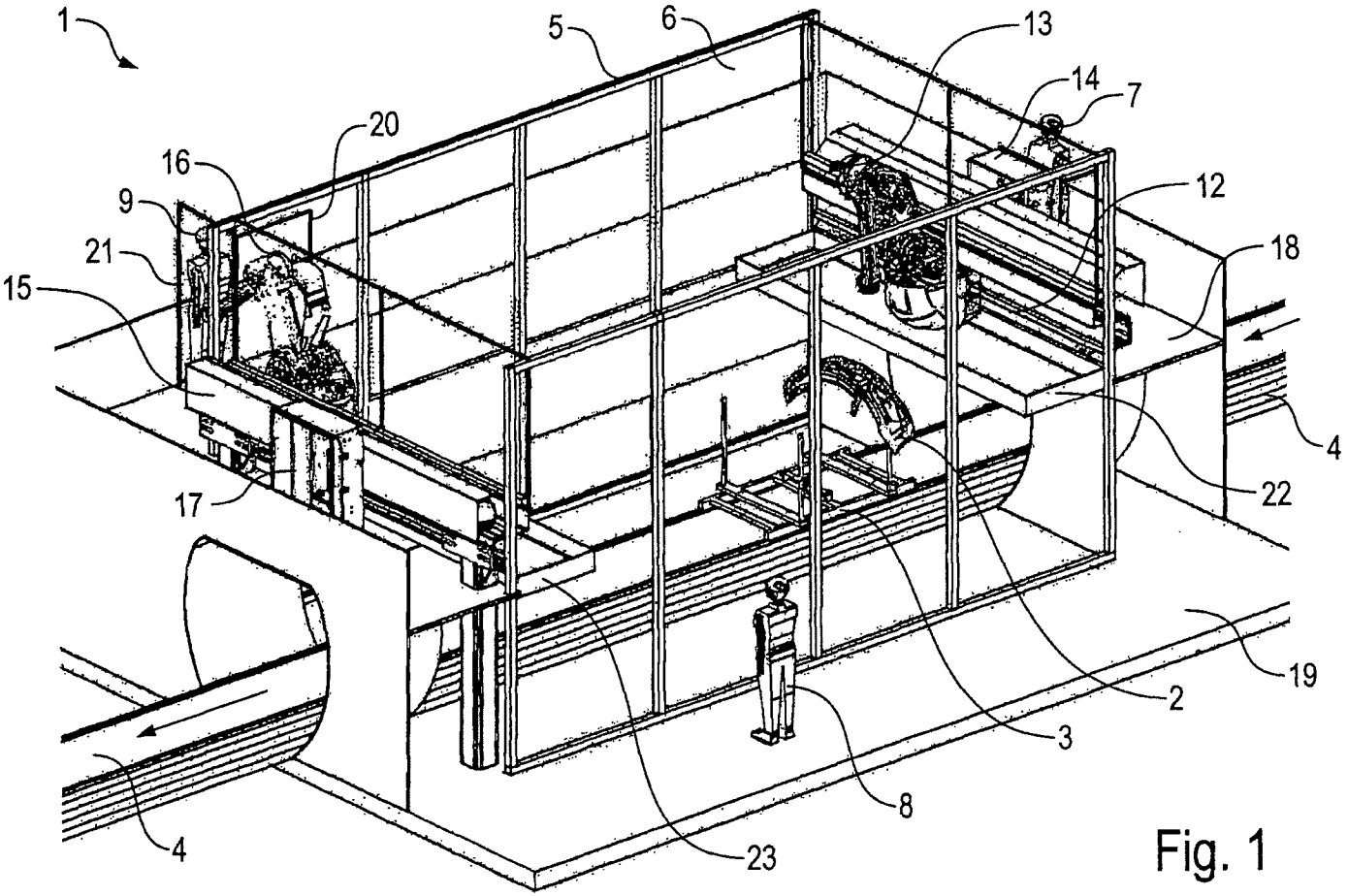
FIGS. 1 and 2 are different three-quarter views of an inventive paint cabin for painting motor vehicle bumpers.
Figure 2:
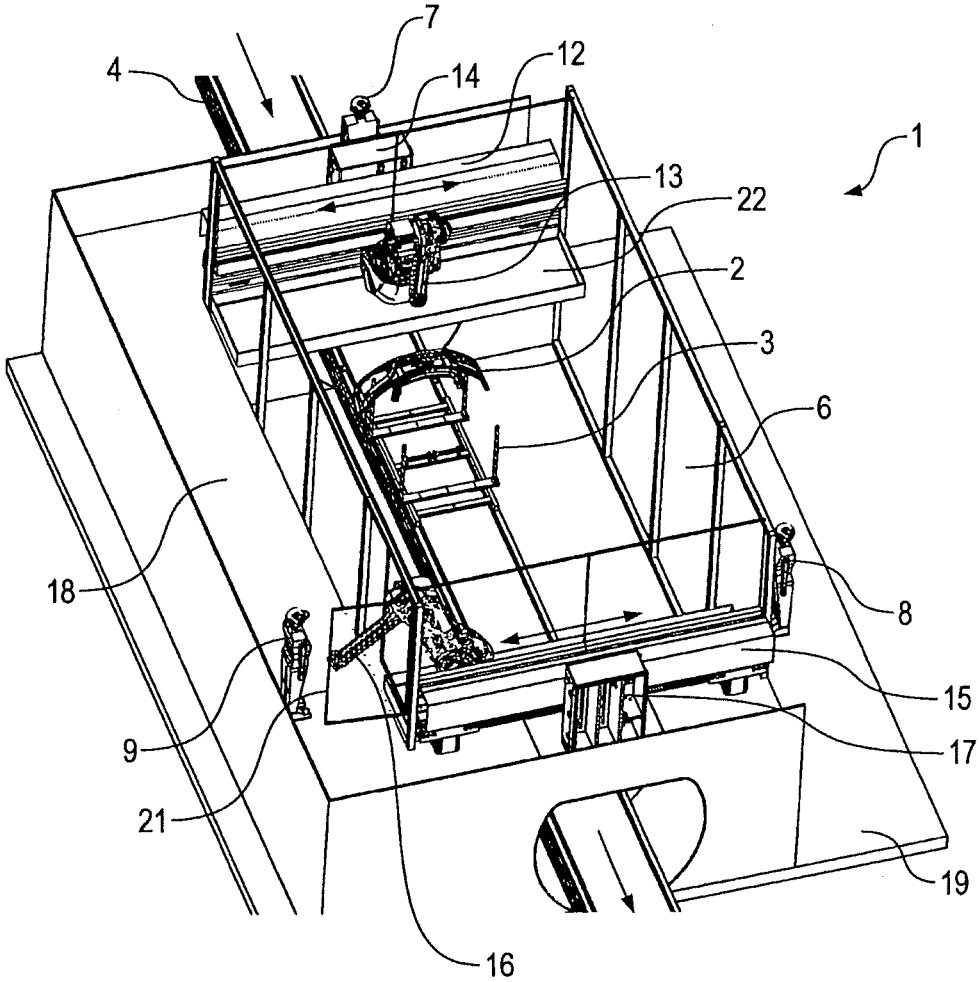

The drawings show a preferred specimen embodiment of an inventive paint cabin 1 for painting motor vehicle bumpers 2, in which the motor vehicle bumpers 2 on a skid 3 are conveyed along a transport path 4 through the paint cabin 1 in the direction shown by the arrow.

Further processing stations (e.g. a dryer) can be located before and after the paint cabin 1 in the direction of transport, but are not shown, for the sake of simplicity.

The paint cabin 1 is designed as a clean room and has a frame 5 in which continuous window panes 6 are set on all sides. Firstly, this offers the advantage that the painting process proceeding inside the paint cabin 1 can be observed from the exterior by operators 7-9. Secondly, the continuous glazing implements a clean room concept, as the paint cabin 1 has no openings through which dirt can penetrate paint cabin 1.

Figure 3:
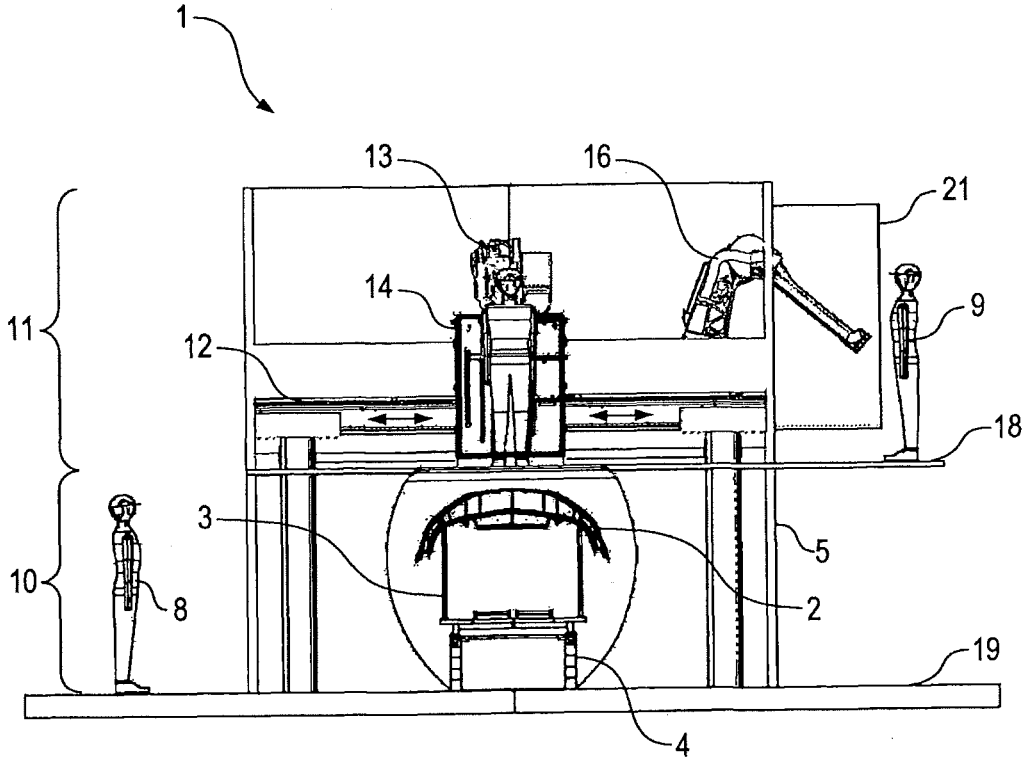
FIG. 3 is a rear view of the paint cabin in FIGS. 1 and 2.
Figure 4:
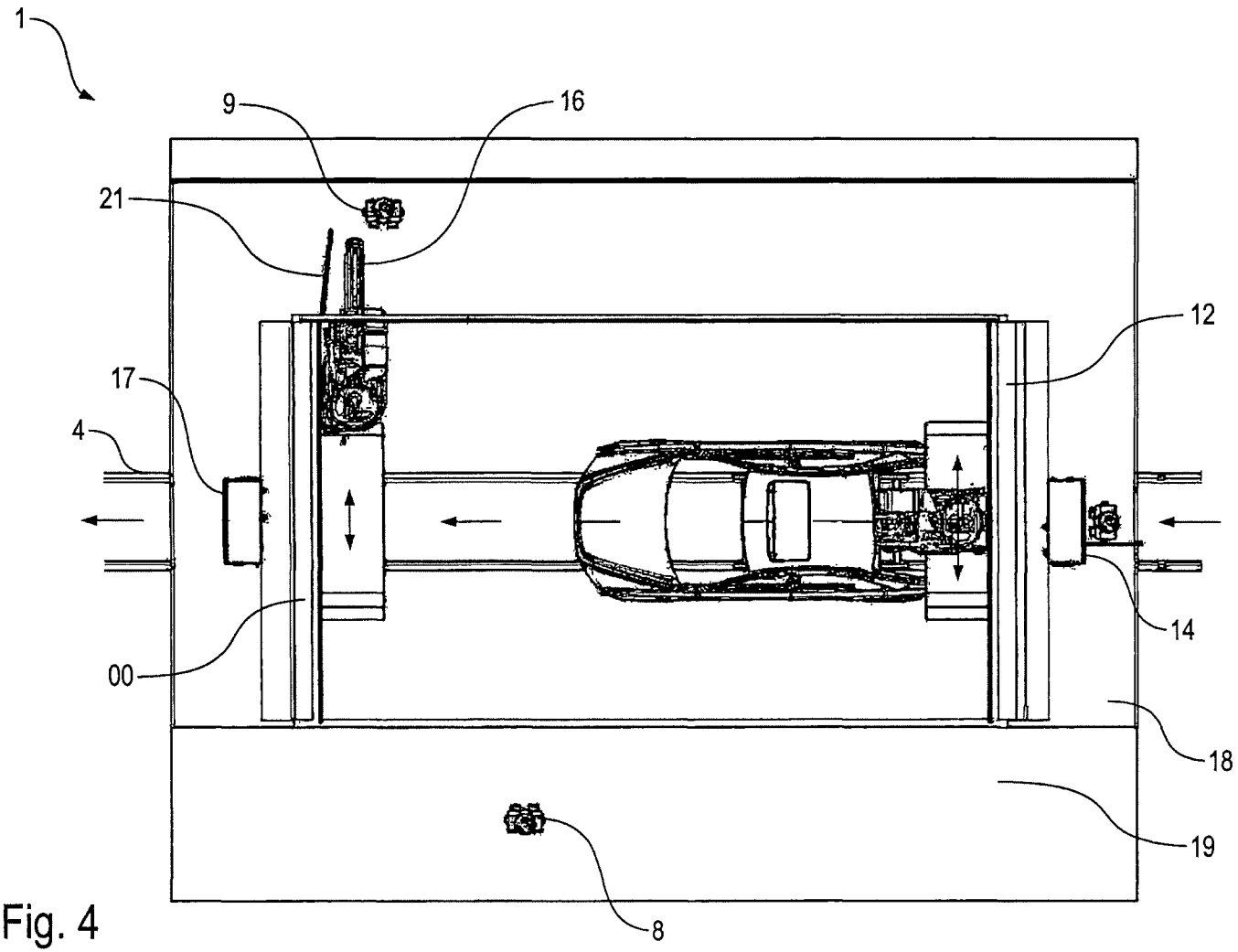
FIG. 4 is a horizontal projection of the paint cabin in FIGS. 1 to 3.
Figure 5:
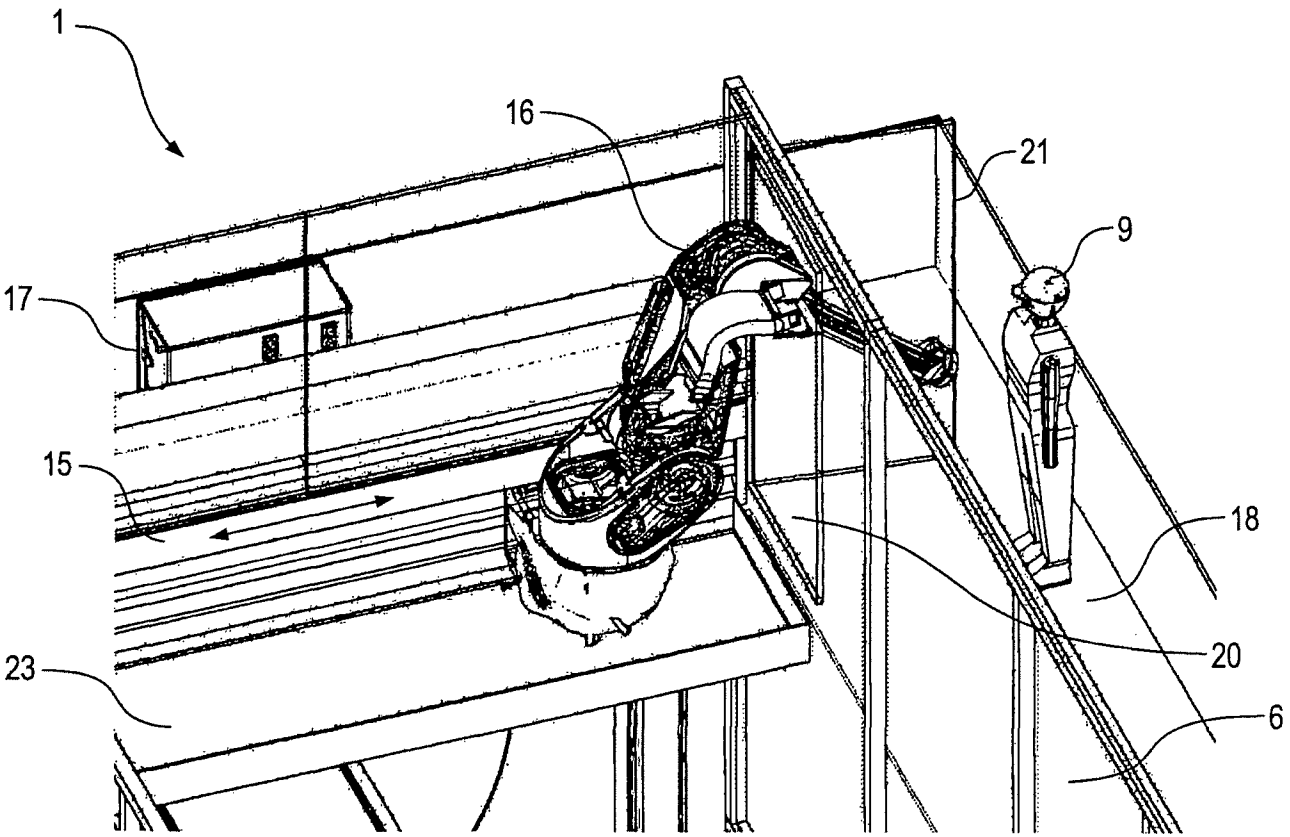
FIG. 5 is a three-quarter detail from the view of the paint cabin in FIGS. 1 to 5, showing an open maintenance aperture.
Figure 6:
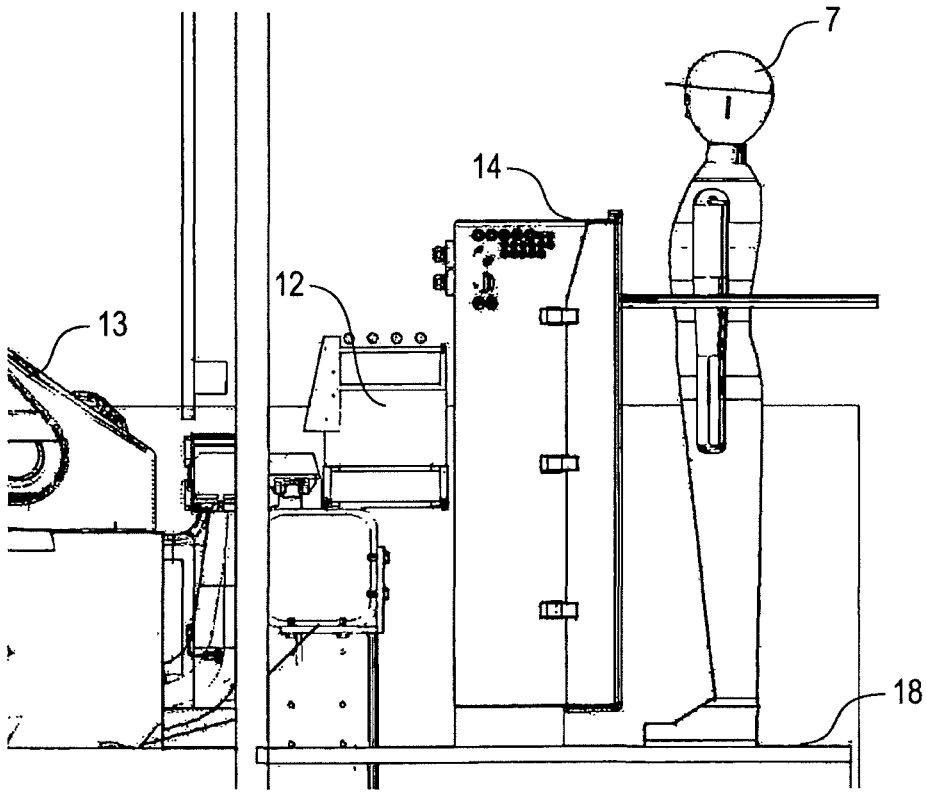
FIG. 6 is a cross-section through a detail of the paint cabin in FIGS. 1 to 5 in the area of an operating catwalk of the paint cabin.

The paint cabin 1 has a lower operating level 10 and an upper maintenance level 11, as is particularly visible in FIG. 3.

In this embodiment, the lower operating level 10 has a height of 1.45 m and is used to accommodate the transport path 4 with the skids 3 and the motor vehicle bumpers 2 on them.

In this embodiment, the upper maintenance level 11 has a height of 1.2 m. A linear travel path 12 for a multiple-axis painting robot 13 with a corresponding supply cabinet 14 is located on the upper maintenance level 11 of the paint cabin 1 at the entrance end.

Another linear travel path 15 for another multiple-axis painting robot 16 with a corresponding supply cabinet 17 is located on the upper maintenance level 11 at the exit end of the paint cabin 1.

The short-side location of the painting robots 13, 16 at the entrance end or exit end of the paint cabin 1 and the erection of the supply cabinets 14, 17 on the same maintenance level 11 as the painting robots 13, 16 advantageously facilitates a continuous clean room concept in the paint cabin 1.

The operators 7-9 can then move around on two catwalks 18, 19 for the operating level 10 or maintenance level 11 of the paint cabin 1.

The upper catwalk 18 extends around the entire perimeter of the paint cabin 1, so that the operators 7, 9 can see into the paint cabin 1 from any direction.

In contrast, the lower catwalk 19 extends only along the long sides of the paint cabin 1, so that the operator 8 can only see into the paint cabin 1 from the side.

The motor vehicle bumpers 2 are conveyed along the transport path 4 into the paint cabin 1 for painting, until the skid 3 is located beneath the painting robot 13 or 16. The painting robot 13 then paints the entire length of the motor vehicle bumper 2 ("from ear to ear"), whereby the painting robot 13 is moved along the travel path 12. The other painting robot 16 operates analogously.

Furthermore, the inventive paint cabin 1 facilitates maintenance of the painting robots 13, 16. For this purpose, a maintenance aperture 20 is located in the side wall of the paint cabin 1, closeable by a door 21. The maintenance aperture 20 laterally adjoins the limit of the travel path 15 of the painting robot 16, which is analogous in design to the opposite painting robot 13 and therefore not described in more detail. For maintenance purposes, the painting robot 16 is therefore moved along the travel path 15 into the maintenance position shown in FIG. 1, in which it is immediately adjacent to the maintenance aperture 20. The operator 9 then opens the door 21 of the maintenance aperture 20 and the painting robot 16 extends the application device used, e.g. a rotary atomiser, out of the paint cabin 1 through the maintenance aperture 20. The maintenance operator 9 can then service the application device outside the paint cabin 1 without having to enter the paint cabin 1.

Finally, it must also be mentioned that a drip tray 22, 23 is located below each painting robot 13, 16 to prevent overspray from dripping down.

The invention is not restricted to the preferred specimen embodiment described above. On the contrary, a variety of alternatives and modifications is possible, also using the inventive concept and therefore being within the scope of protection.

LIST OF REFERENCE NUMBERS

1 Paint cabin
2 Motor vehicle bumper
3 Skid
4 Transport path
5 Frame
6 Window panes
7-9 Operators
10 Operating level
11 Maintenance level
12 Travel path
13 Painting robot

14 Supply cabinet
15 Travel path
16 Painting robot
17 Supply cabinet
18, 19 Catwalks
20 Maintenance aperture
21 Door
22, 23 Drip tray

The invention claimed is:

1. A paint shop comprising:

a transport path for conveying components to be painted through the paint shop;

a painting robot for painting the components;

a travel path to position the painting robot along the travel path, wherein the travel path of the painting robot extends transverse to the transport path for the components to be painted; and a paint booth comprising an upper maintenance level positioned above a lower operating level, wherein the transport path is arranged in the lower operating level, wherein the travel path of the painting robot is arranged in the upper maintenance level to allow access by an operator positioned on the upper maintenance level; and further wherein the transport path for the components to be painted extends through the paint booth, where the travel path for the painting robot has a painting position inside the paint booth and a servicing position outside the paint booth; wherein the servicing position includes at least a portion of the painting robot being outside of the paint booth.

2. The paint shop according to claim 1, wherein the components to be painted are elongate and aligned transverse to the transport path.

3. The paint shop according to claim 1, wherein the components to be painted are elongate and aligned parallel to the travel path of the painting robot.

4. The paint shop according to claim 1, wherein the travel path with the painting robot is located above the transport path with the components to be painted.

5. The paint shop according to claim 1, wherein the transport path and the travel path are both linear.

6. The paint shop according to claim 1, wherein the transport path and the travel path are aligned substantially at right angles to each other.

7. The paint shop according to claim 1, further comprising a drip tray located below the painting robot, to protect the components to be painted on the transport path from contamination from above.

8. A painting robot according to claim 1, wherein the transport path extends in a tunnel beneath the painting robot, to protect the components to be painted on the transport path from contamination from above.

9. The paint shop according to claim 1, wherein the painting robot is located in the paint booth, whereby the travel path is located with the painting robot at the entrance of the paint booth.

10. The paint shop according to claim 1, wherein the painting robot is located in the paint booth, whereby the travel path is located with the painting robot at the exit of the paint booth.

11. The paint shop according to claim 1, wherein the painting robot is located in the paint booth which has a closeable maintenance aperture, whereby the maintenance aperture facilitates maintenance of the painting robot when open.

12. The paint shop according to claim 11, wherein the maintenance aperture is located at the side of the paint booth and the travel path has a maintenance position for the painting robot in which the painting robot is adjacent to the maintenance aperture.

13. The paint shop according to claim 11, wherein the painting robot carries an application system which can be extended outside the paint booth through the open maintenance aperture by the painting robot, so that the application system may be serviced outside the paint booth.

14. The paint shop according to claim 13, wherein the application system comprises an application device and a colour changer.

15. The paint shop according to claim 1, wherein the paint booth includes at least one wall, the at least one wall being at least partially transparent; and further comprising at least one accessible catwalk, whereby the catwalk is mounted on the side of the paint cabin.

16. The paint shop according to claim 15, further comprising a second accessible catwalk; wherein the two accessible catwalks, one above the other, are affixed to a side of the paint booth.

17. The paint shop according to claim 15, wherein the catwalk extends around the entire perimeter of the paint booth.

18. The paint shop according to claim 15, wherein the catwalk extends only along the long sides of the paint booth.

19. The paint shop according to claim 15, wherein the catwalk extends only along the short sides of the paint booth.

* * * * *